US010087712B2

(12) United States Patent
Kennedy

(10) Patent No.: US 10,087,712 B2
(45) Date of Patent: Oct. 2, 2018

(54) PRESSURE ACTUATED DOWNHOLE TOOL

(71) Applicant: Shale Oil Tools, LLC, Sugar Land, TX (US)

(72) Inventor: Brian Kennedy, Sugar Land, TX (US)

(73) Assignee: Shale Oil Tools, LLC, Sugar Land, TX (US)

( * ) Notice: Subject to any disclaimer, the term of this patent is extended or adjusted under 35 U.S.C. 154(b) by 1030 days.

(21) Appl. No.: 14/496,408

(22) Filed: Sep. 25, 2014

(65) Prior Publication Data

US 2016/0090815 A1 Mar. 31, 2016

(51) Int. Cl.
*E21B 23/00* (2006.01)
*E21B 23/04* (2006.01)
*E21B 34/14* (2006.01)

(52) U.S. Cl.
CPC ..... *E21B 34/14* (2013.01); *E21B 23/006* (2013.01); *E21B 23/04* (2013.01)

(58) Field of Classification Search
CPC ..... E21B 23/006; E21B 23/04; E21B 34/14
See application file for complete search history.

(56) References Cited

U.S. PATENT DOCUMENTS 3,837,403 A * 9/1974 Mott ..... E21B 23/006 166/240
3,986,554 A * 10/1976 Nutter ..... E21B 34/108 166/151
4,355,685 A * 10/1982 Beck ..... E21B 23/006 166/240
5,529,126 A 6/1996 Edwards
6,152,224 A * 11/2000 French ..... E21B 23/006 166/130
6,173,795 B1 * 1/2001 McGarian ..... E21B 21/10 166/321
7,281,584 B2 * 10/2007 McGarian ..... E21B 21/103 166/169
7,337,847 B2 * 3/2008 McGarian ..... E21B 21/103 166/331

(Continued)

OTHER PUBLICATIONS

International Search Report and Written Opinion dated Dec. 18, 2015 for PCT/US2015/051223 filed Sep. 21, 2015.

*Primary Examiner* — Matthew R Buck
(74) *Attorney, Agent, or Firm* — The Kubiak Law Firm

(57) ABSTRACT

In wellbore completions it is desirable to cement or otherwise seal the casing to the wellbore. Many times such operations include sealing the interior of the casing against flow. In those instances a means to open the interior of the casing to fluid flow and thereby establish circulation in the well upon command is needed. Additionally it is desirable to be able to pressurize the well several times prior to establishing circulation. In an embodiment of the current invention an interior sleeve block fluid flow through ports in the housing. The inner sleeve is coupled to a j-slot so that a pressurization cycle will move the inner sleeve and cause the inner sleeve to rotate a predetermined distance. Upon reaching the access position in the j-slot the sleeve is allowed to move to a fully open position. Additionally when the inner sleeve is in a pressurized position the inner sleeve is supported so that high pressure in excess of the pressure required to actuate a pressure cycle may be applied without damage to the toe sleeve or inner sleeve.

13 Claims, 5 Drawing Sheets

(56) References Cited

U.S. PATENT DOCUMENTS

| | | | | |
|---|---|---|---|---|
| 8,272,445 | B2 * | 9/2012 | Fay | E21B 23/006 137/625.48 |
| 8,307,902 | B2 * | 11/2012 | Telfer | E21B 21/103 137/625.27 |
| 9,359,865 | B2 * | 6/2016 | Mailand | E21B 23/006 |
| 9,611,719 | B2 * | 4/2017 | Hofman | E21B 34/10 |
| 9,784,070 | B2 * | 10/2017 | Neer | E21B 34/108 |
| 2002/0112862 | A1 * | 8/2002 | Patel | E21B 23/006 166/386 |
| 2005/0263279 | A1 | 12/2005 | Vachon | |
| 2007/0102163 | A1 | 5/2007 | Heath et al. | |

* cited by examiner

PRESSURE ACTUATED DOWNHOLE TOOL

BACKGROUND

In the oilfield it has become common practice to drill a well that intersects numerous formations or portions of formations. Sometimes the well may be primarily vertical and sometimes the well may have a significant horizontal section. Once the wellbore has been drilled it is usually necessary to case the well. In the past the casing was typically a number of joints of solid pipe joined together and then run into the wellbore. Once the casing had been located in the wellbore it was then cemented in place by forcing cement through the interior of the pipe, out of the toe of the pipe, and back up around the annular area formed between the casing and the wellbore itself.

With the casing cemented in the well the interior of the pipe casing was effectively sealed from allowing any fluids to flow from the formations to the interior. With the casing effectively sealed against fluid flow it is then necessary to provide a means to access the exterior of the casing and reestablish fluid flow upon demand. Typically the casing is perforated or a ported sleeve is used to reestablish fluid flow with the exterior the casing. The ported sleeve is commonly referred to as a toe sleeve. Because positive fluid flow through the casing is limited at best without access to the exterior of the casing, it is difficult to pump a ball or a dart through the casing to actuate the toe sleeve. Therefore toe sleeve actuation is limited to pressure actuation or mechanical manipulation from the surface such as the use of slick line or electric line. Today many toe sleeves are actuated by pressure. Unfortunately there may be other requirements to pressurize the casing prior to actuating the toe sleeve. For instance it may be necessary to check the integrity of the casing and the cement holding the casing in place by performing a pressure test on the casing. In such instances it is not uncommon to pressurize the casing to 10,000 psi or more. Any toe sleeve actuation greater than the pressure test creates uncertainty as to whether the toe sleeve actuated or the casing failed.

SUMMARY

In order to overcome at least the aforementioned issue an embodiment of the present invention allows for the casing to be pressurized and depressurized a predetermined number of times prior to actuating the toe sleeve. Additionally each pressurization cycle may be well in excess of the amount of pressure that it takes to open the toe sleeve on the toe sleeve actuation cycle.

More specifically in this embodiment the toe sleeve has an inner sleeve with a first and second total piston area. The inner sleeve also has a first, second, and third longitudinal position. Additionally the inner sleeve has rotary indexing device such as an indexing j-slot profile formed on the exterior surface of the inner sleeve. The final portion of the j-slot profile extends a sufficient longitudinal distance to allow the inner sleeve to move to a point where interior fluid pressure may reach the second piston area. The toe sleeve has a bottom sub, a top sub, and a ported sub where the ported sub is disposed around the inner sleeve. In many instances the bottom sub, top sub, or ported sub may be combined into single assemblies. A lug may be positioned in the ported sub where the lug engages the indexing j-slot of the inner sleeve piston. In certain instances the lug may be incorporated into the inner sleeve while the j-slots may be incorporated into a housing or other exterior subassembly.

The housing is disposed around the inner sleeve piston and bottom sub. In many instances different combinations of the bottom sub, top sub, ported sub and housing may be combined into single assemblies. The toe sleeve has an atmospheric chamber formed by the housing, the inner sleeve, and the bottom sub. The toe sleeve also has a spring chamber in the housing between the inner sleeve and the housing. A biasing device such as a spring, pressurized chamber, or other means to store energy resides in the spring chamber to provide a return force to the inner sleeve in the absence of pressure against the first piston area on the sleeve.

When pressure is applied from the surface to the inner sleeve piston. The inner sleeve moves from its first position to a second position as provided for by the lug travelling in the indexing j-slot of the inner sleeve. When the inner sleeve moves from a first position to a second position the inner sleeve moves longitudinally in the housing it also rotates some slight amount. As pressure from the surface is relieved the biasing device shifts the inner sleeve longitudinally in the opposite direction and the inner sleeve again rotates some small amount. While the longitudinal movement of the inner sleeve is back and forth, the rotational movement is all in a single direction. Shoulders on the ported sub as well as the lug or lugs, if more than one j-slot is used to provide a backstop preventing the inner sleeve from damaging the lug or lugs in the instance that very high pressure is exerted against the interior piston of the inner sleeve.

When a pre-determined number of pressure cycles occur the inner sleeve is rotated so that the lug travels to a longer slot profile of the indexing j-slot profile so that inner sleeve is allowed to move to the third position. As the inner sleeve moves through the longer slot profile a seal is eliminated and the second piston area of the inner sleeve is exposed. Upon exposure of the second piston area, the total piston area reverses and thus the force due to fluid pressure from the interior of the toe sleeve and acting upon the inner sleeve aligns with the biasing device and now works to move the inner sleeve and open the ports. The piston force acting on the second piston area causes the inner sleeve to move into the atmospheric chamber and shoulders the inner sleeve piston against the bottom sub. Opening the plurality of ports in the ported sub allows the fluid in the tubing/casing string to exit the tubing/casing string and make contact with the formation.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
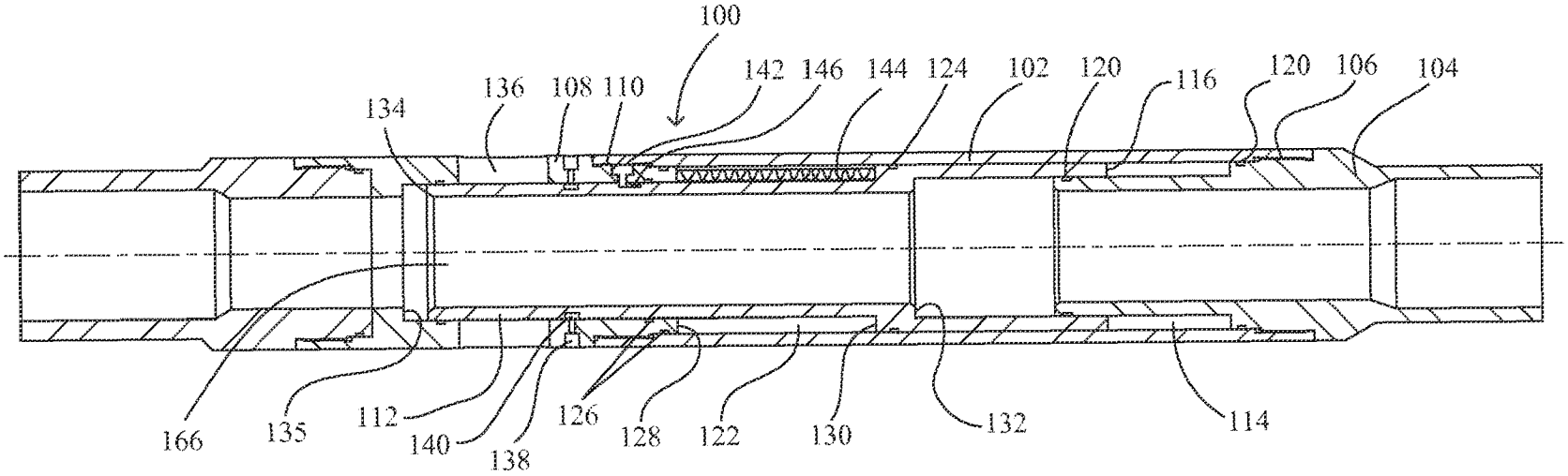
FIG. 1 is a cross-section of a toe sleeve in its unpressurized and closed condition.

FIG. 1 is a cross-section of a toe sleeve 100 in its unpressurized and closed condition. The toe sleeve 100 has an outer housing 102 at the housing's 102 lower end is the bottom sub 104. The bottom sub 104 is attached to the housing 102 by threads 106, although the housing 102 and the bottom sub 104 may be attached by any other applicable means such as welding or the housing 102 and bottom sub 104 may be made as a single piece. At the upper end of the housing 102 is the ported sub 108. The ported sub 108 is attached to the housing 102 via threads 110, although the housing 102 and the ported sub 108 may be attached by any other applicable means such as welding or the housing 102 and ported sub 108 may be made as a single piece. The inner sleeve 112 is coaxial with the housing 102 and resides in the interior of the housing 102. The lower end of the inner sleeve 112 is limited in its downward travel by the bottom sub 104. The lower end of the inner sleeve 112 resides in a first chamber 114 formed by the housing 102, the bottom sub 104, and a lower face 116 of the inner sleeve 112. The first chamber 114 is isolated from wellbore or other fluids by seals such as O-rings 120 and 124. By keeping the first chamber 114 isolated from wellbore and other incompressible fluids the lower end of inner sleeve 112 is able to move into the first chamber 114 as needed. A second chamber 122 is formed by the housing 102, the inner sleeve 112 and the ported sub 108. The second chamber 122 is isolated from wellbore or other fluids by seals such as O-rings 124 and 126. Within the second chamber 122 is a biasing device 144 such as a spring or compressed gas. The biasing device 144 acts against lower face 128 of the ported sub 108 and ask against the third piston face 130 of inner sleeve 112. The inner sleeve 112 has a downward facing shoulder exposed to fluid in the interior 166 of the toe sleeve 100 the downward facing shoulder acts as first piston 132 at the upper end of the inner sleeve 112 is an upward facing shoulder that acts as a second piston 134.

The ported sub 108 has at least one port 136. In the event that inner sleeve 112 should slide downward a sufficient amount the inner sleeve 112 will uncover port 136 to allow fluid flow through port 136 from the interior 166 of the toe sleeve 100 to the exterior of the toe sleeve 100. The ported sub 108 also has at least one shear pin 138 shear pin 138 extends through the ported sub 108 and into a recess 140 cut in the exterior of the inner sleeve 112. The shear pin 138 when engaged with recess 140 and the inner sleeve 112 prevents the inner sleeve 112 from moving in relation to the ported sub 108. Any motion that might prematurely cause the inner sleeve 112 to cycle is not desired. Such operations may include running the casing that includes the toe sleeve 100 into the well and flowing cement through the interior of the tubular including the toe sleeve 100. However upon the application of sufficient fluid pressure through the interior of the tubular and thus the interior 166 of the toe sleeve 100, pressure is exerted against first piston 132 and second piston 134. The areas of piston 132 and 134 together form a first piston area and are calculated so that the area of piston 132 is greater than the area piston 134 so that the applied pressure will cause the inner sleeve to move upward within the housing 102 initially shearing the shear pin 138. A lug 142 in the ported sub 108 extends into a slot 146 that is been cut into the exterior circumferential surface of inner sleeve 112. A shoulder 135 on the ported sub 108 may engage the second piston 134 of inner sleeve 112 as the inner sleeve moves upward during a pressure cycle.

Figure 2:
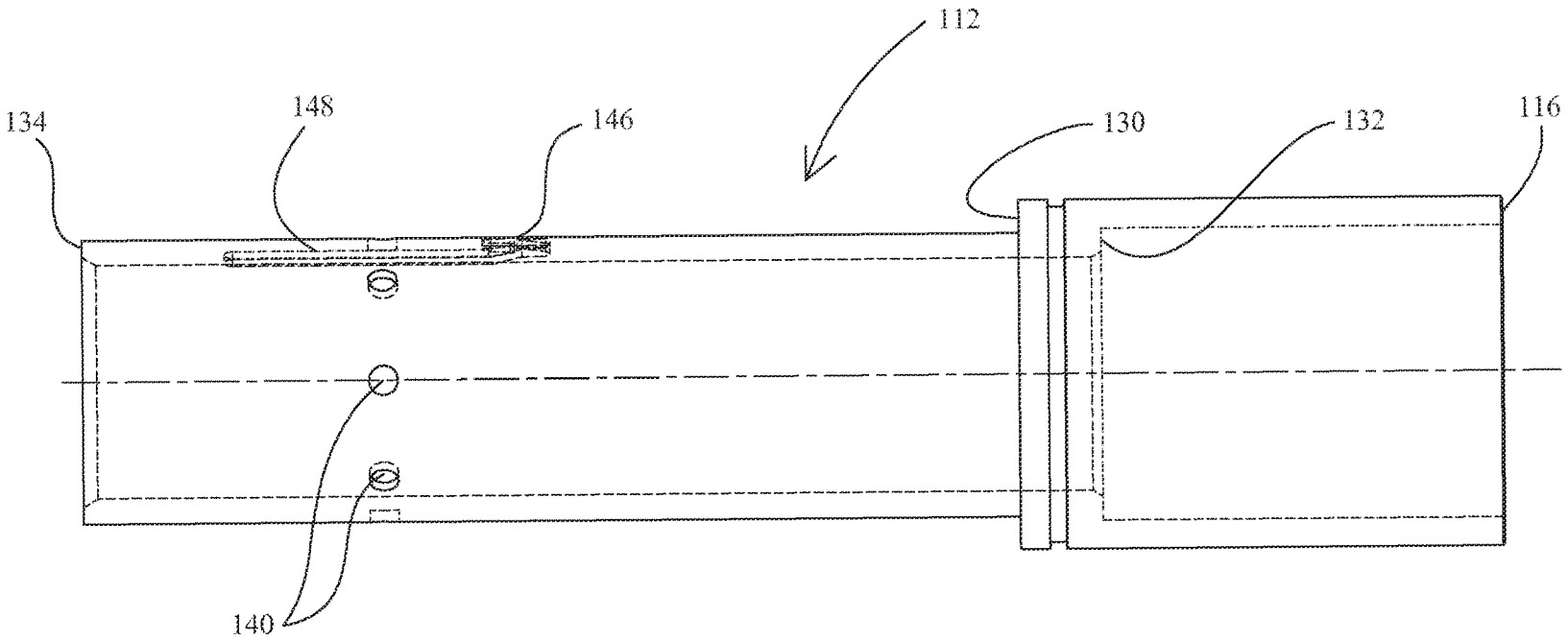
FIG. 2 is a depiction of the inner sleeve.

FIG. 2 shows the inner sleeve 112 with the first piston 132 towards the lower end of inner sleeve 112 second piston 134 is at the upper end of inner sleeve 112. Multiple recesses 140 are shown about the periphery of the exterior surface of inner sleeve 140. The number of recesses 140 depends upon the desired level of restraint of the inner sleeve 112 when pressure is exerted against shoulders 132 and 134. The slots 146 are on the exterior surface of the inner sleeve wall and the extended slot 148 passes longitudinally between recesses 140. The slots 146 may extend partially around the circumferential distance of the sleeve 112 or depending upon the number of pressure cycles desired may extend around essentially the entire circumferential distance.

Figure 3:
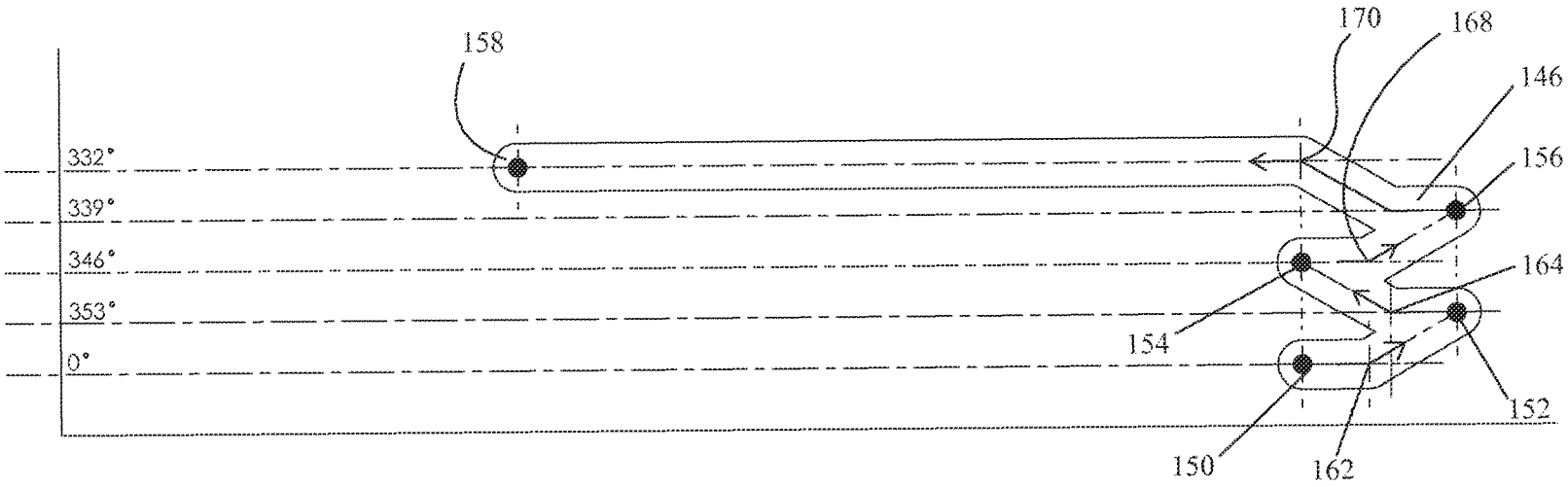
FIG. 3 is a depiction of the slot profile of the inner sleeve.

FIG. 3 is a close-up depiction of the slot profile 146. Once the shear pins 138 release the inner sleeve 112 the initial pressure cycle allows the lug 142 to move from its first position 150 through the slot 146 as indicated by arrow 162 to the second position 152. As pressure is exerted on piston surface 132 and with the inner sleeve in the second position the second piston 134 may land on shoulder 135 of the ported sub 108. Once piston 134 lands on shoulder 135 the pressure inside the toe sleeve 100 may be increased as desired without cycling the toe sleeve 100 or allowing fluid access through the ports 136.

Figure 4:
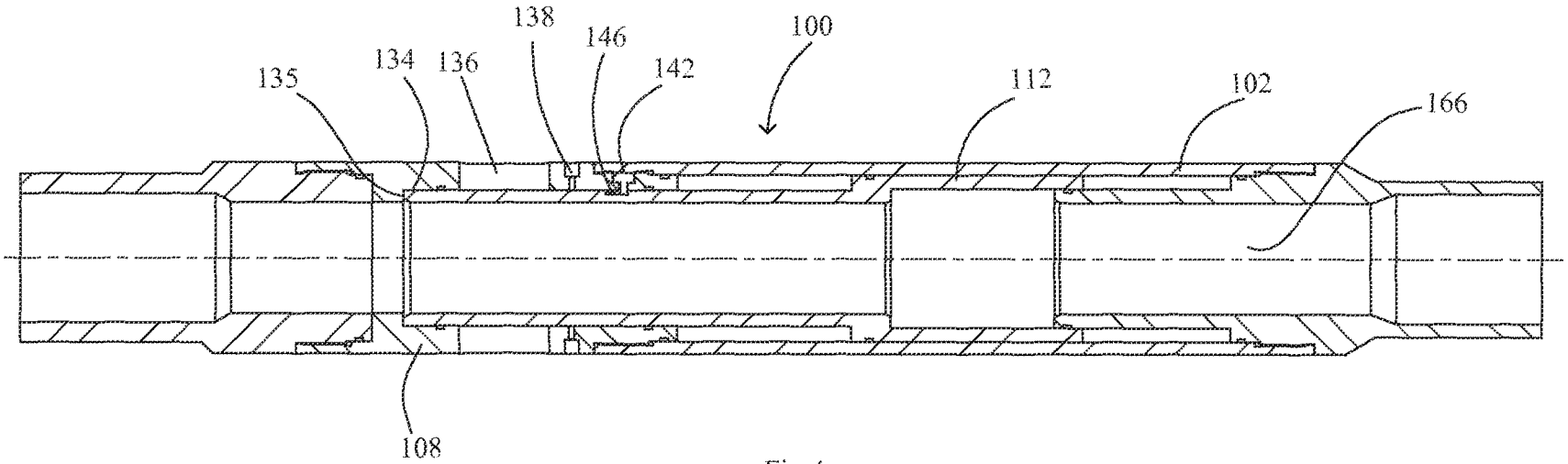
FIG. 4 depicts a side view of the toe sleeve with the inner sleeve in the pressurized condition.

FIG. 4 depicts a side view of toe sleeve 100 with the inner sleeve 112 and the lug 142 in the second position 152 of the j-slot 146. With the lug 142 in the second position 152 of the j-slot 146 the inner sleeve 112 has moved upward within the housing 102 and the ported sub 108 such that additional support, to resist additional pressure that may be exerted within the interior 166 of toe sleeve 100, the second piston 134 contacts shoulder 135 and ported sub 108. As can be seen the shear pin 138 is been sheared and port 136 remains closed.

As pressure is relieved in the interior 166 of the toe sleeve 100, the biasing device 144 overcomes the force exerted upon the toe sleeve 100 through pistons 132 and 134 and exerts force against the third piston 130. As inner sleeve 112 moves downward the lug 142 moves from the second position 152 to the third position 154 as indicated by arrow 164. During the next pressure cycle as pressure is again exerted against piston surfaces 132 and 134 the inner sleeve 112 again moves upward causing the lug 142 to move from the third position 154 to the fourth position 156 as indicated by arrow 168. As pressure is once again relieved in the interior 166 of the toe sleeve 100, the biasing device 144 overcomes the force is exerted upon the toe sleeve 100 through pistons 132 and 134 and exerts pressure against the third piston 130 moving the inner sleeve 112 downward. As inner sleeve 112 moves downward the lug 142 moves from the fourth position 156 to the fifth position 158 as indicated by arrow 170. The inner sleeve 112 moves downward towards the fifth position, in this case the fifth position is displaced a sufficient distance to allow the inner sleeve 112 to move past the seals and allow fluid pressure to access the area circumferentially outward from the inner sleeve 112 and towards the ports 136. In the fifth position the second piston area is accessed by the pressurized fluid in the interior 166 of the inner sleeve 112. The second piston area is the combination of the second piston 134 and the third piston 130 less the area of the first piston 132 in combination with the force acting against each due to the pressure of the fluid in the toe sleeve 100. The total force exerted against the piston faces acts to move the inner sleeve 112 downward. Once fluid pressure can move radially outward of the inner sleeve 112 the fluid can reach piston 130 thereby forcing a portion of the inner sleeve 112 into the first chamber 114 thereby allowing full access for fluid to flow from the interior 166 of the toe sleeve 100 to the exterior of the toe sleeve 100 through port 136.

Figure 5:
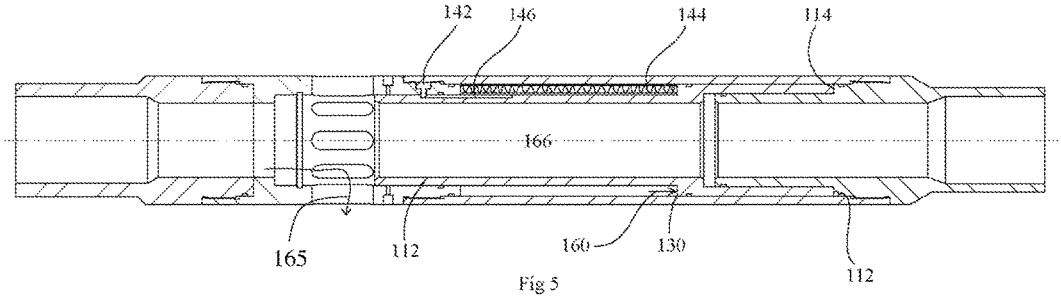
FIG. 5 depicts a side view of toe sleeve with the inner sleeve open allowing fluid flow through the ports.

FIG. 5 depicts a side view of toe sleeve 100 with the lug 142 in the fifth position 158 in the j-slot 146. With fluid now able to flow to the radially outward side of the inner sleeve 112 as depicted by arrow 162 the fluid acts against the third piston 130 as shown by arrow 160 in assisting the bias device in pushing the third piston 130 of the inner sleeve 112 into the second chamber 114 a sufficient amount to operationally open the ports 136 further allowing fluid flow from the interior 166 of the toe sleeve 100 through ports 136 to the exterior of the toe sleeve 100.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A downhole device comprising:

a housing, an inner sleeve within the housing, wherein the inner sleeve has at least a first upper position, a second upper position, a first lower position, and a second lower position, a rotary index coupled to the housing and to the inner sleeve, wherein a fluid moves the inner sleeve to advance the rotary index, wherein the fluid exerts a force on the inner sleeve towards the first upper position and the second upper position, and a bias device is located between the housing and the inner sleeve, wherein the bias device exerts a force on the inner sleeve towards the first lower position and the second lower position, wherein the fluid is configured to flow to an exterior of the inner sleeve when the inner sleeve is in at least the second lower position.

2. The downhole device of claim 1 wherein, the housing has at least one port.

3. The downhole device of claim 2 wherein, the inner sleeve in the first upper position and the second upper position restricts the fluid flow through the at least one port.

4. The downhole device of claim 2 wherein, the inner sleeve in the second lower position allows the fluid flow through the at least one port.

5. The downhole device of claim 1 wherein, the bias device is a spring.

6. The downhole device of claim 1 wherein, the bias device is a compressed gas.

7. The downhole device of claim 1 wherein, the inner sleeve contacts a housing shoulder when in the first upper position.

8. A method of utilizing a downhole tool comprising, pressurizing a piston area between an inner sleeve and a housing with a fluid, wherein the fluid exerts a force on the inner sleeve to move the inner sleeve to a first upper position, wherein the inner sleeve rotates from a first lower position to the first upper position, biasing the inner sleeve with a bias device located between the housing and the inner sleeve, wherein depressurizing the piston area between the inner sleeve and the housing allows the inner sleeve to move from the first upper position to a second lower position, wherein the inner sleeve rotates from the first upper position to the second lower position, pressurizing the piston area between the inner sleeve and the housing, wherein the fluid exerts a force on the inner sleeve to move the inner sleeve from the second lower position to a second upper position, wherein the inner sleeve rotates from the second lower position to the second upper position, and biasing the inner sleeve wherein depressurizing the piston area between the inner sleeve and the housing allows the inner sleeve to move from the second upper position to a third lower position, wherein the inner sleeve rotates from the second upper position to the third lower position, wherein the bias device exerts a force on the inner sleeve towards the first lower position the second lower position, and the third lower position, wherein the fluid is configured to flow to an exterior of the inner sleeve when the inner sleeve is in at least the third lower position.

9. The method of utilizing a downhole tool of claim 8 wherein, the inner sleeve in the first upper position and the second upper position restricts the fluid flow through at least one port in the housing.

10. The method of utilizing a downhole tool of claim 8 wherein, the inner sleeve in the third lower position allows the fluid flow through at least one port in the housing.

11. The method of utilizing a downhole tool of claim 8 wherein, the bias device is a spring.

12. The method of utilizing a downhole tool of claim 8 wherein, the bias device is a compressed gas.

13. The method of utilizing a downhole tool of claim 8 wherein, the inner sleeve contacts a housing shoulder when in the first upper position.

* * * * *